US009249490B2

(12) United States Patent
Trzcinski et al.

(10) Patent No.: US 9,249,490 B2
(45) Date of Patent: Feb. 2, 2016

(54) MASK SYSTEM FOR GAS TURBINE ENGINE COMPONENT

(71) Applicant: United Technologies Corporation, Hartford, CT (US)

(72) Inventors: Frank J. Trzcinski, Ellington, CT (US); Chelsea Brown, Newington, CT (US); Kevin Castonguay, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 284 days.

(21) Appl. No.: 13/707,252

(22) Filed: Dec. 6, 2012

(65) Prior Publication Data

US 2014/0157595 A1 Jun. 12, 2014

(51) Int. Cl.

| | |
|---|---|
| ***B05B 15/04*** | (2006.01) |
| ***C23C 4/00*** | (2006.01) |
| *F01D 5/28* | (2006.01) |

(52) U.S. Cl.

CPC ..... *C23C 4/005* (2013.01); *B05B 15/045* (2013.01); *F01D 5/288* (2013.01); *Y10T 29/49229* (2015.01); *Y10T 29/53* (2015.01)

(58) Field of Classification Search

CPC .... B05B 15/045; B05B 15/0456; B05D 1/32; B05D 3/12; B23P 19/02; B23P 19/003; B23P 19/107; B23P 21/00; B23P 2700/13; C23C 2/006; C23C 8/04; C23C 10/04; C23C 14/04; C23C 14/042; C23C 16/04; C25D 5/02; C25D 5/022

See application file for complete search history.

(56) References Cited

U.S. PATENT DOCUMENTS

| | | | | |
|---|---|---|---|---|
| 4,530,861 | A | 7/1985 | Sippel et al. | |
| 5,565,035 | A * | 10/1996 | Sylvestro et al. | 118/721 |
| 5,792,267 | A * | 8/1998 | Marszal et al. | 118/500 |
| 5,985,122 | A | 11/1999 | Conner | |
| 6,082,291 | A * | 7/2000 | Ittleson et al. | 118/500 |
| 6,177,038 | B1 | 1/2001 | Reed et al. | |
| 6,224,361 | B1 * | 5/2001 | Reed et al. | 425/110 |
| 6,258,226 | B1 | 7/2001 | Conner | |
| 6,273,676 | B1 * | 8/2001 | Brooks et al. | 415/191 |
| 6,296,705 | B1 * | 10/2001 | Ireland et al. | 118/505 |
| 6,685,107 | B1 * | 2/2004 | Salzman | 239/310 |
| 6,863,927 | B2 * | 3/2005 | Langley et al. | 427/252 |
| 7,632,541 | B2 | 12/2009 | Saylor et al. | |
| 8,105,133 | B2 | 1/2012 | Jayabalan | |
| 2004/0005409 | A1 | 1/2004 | Das et al. | |
| 2005/0227589 | A1 * | 10/2005 | Oussaada et al. | 451/29 |
| 2006/0021579 | A1 * | 2/2006 | Bernaski et al. | 118/720 |
| 2010/0000468 | A1 | 1/2010 | Saylor et al. | |
| 2011/0239934 | A1 | 10/2011 | Soucy et al. | |
| 2012/0171045 | A1 * | 7/2012 | Spangler et al. | 416/241 R |
| 2012/0190272 | A1 | 7/2012 | Trzcinski et al. | |
| 2013/0052344 | A1 * | 2/2013 | Woodard et al. | 427/230 |

FOREIGN PATENT DOCUMENTS

| | | | | |
|---|---|---|---|---|
| EP | 1116523 | A2 * | 7/2001 | B05B 15/00 |
| EP | 2471607 | A1 * | 7/2012 | |

* cited by examiner

*Primary Examiner* — Alexander P Taousakis
(74) *Attorney, Agent, or Firm* — O'Shea Getz P.C.

(57) ABSTRACT

A system to install a mask onto a component of a gas turbine engine includes a drive movable along an axis with respect to a movable base.

19 Claims, 8 Drawing Sheets

MASK SYSTEM FOR GAS TURBINE ENGINE COMPONENT

BACKGROUND

The present disclosure relates to plating deposition processes and equipment, and more particularly, to a method and masking assembly for selectively depositing a plating on a turbine airfoil while preventing deposition of the plating on a dovetail of the airfoil.

Gas turbine engines, such as those that power modern commercial and military aircraft, generally include a compressor section to pressurize an airflow, a combustor section to burn hydrocarbon fuel in the presence of the pressurized air, and a turbine section to extract energy from the resultant combustion gases.

Turbine section blades typically include an airfoil which extends into the hot core gases which result from the combustion of fuel in the upstream combustor section. Because of the high temperatures and corrosive effects of such gases on the airfoil s, standard practice may include application of a protective plating that provide insulation from the high temperatures and corrosive effects.

A root opposite the airfoil attaches the blade to a rotor disk of the engine and is not in need of protection from the high temperatures and corrosive effects of the hot core gases. The root often has a fir-tree shape that is assembled into a corresponding slot in a rotor disk such that after a prolonged time period, the root may exhibit a fatigue-related phenomenon referred to as fretting. Fretting has been found to be exacerbated by plating. Thus, in order to achieve the desired properties in the various s of the turbine airfoil to maximize service life only the airfoil is plated.

One method to plate only the airfoil is to segregate the airfoil with a mask that protects the root and platform underside before insertion into the plating solution. An operator manually inserts the airfoil into a mask. Installation may be relatively difficult and time consuming as the operator usually requires two hands and a wood table as leverage to wiggle the airfoil into the mask. As a gas turbine engine may contain upwards of eighty airfoils in one stage and multiple different stages, masking turbine components may be time consuming and expensive.

SUMMARY

A system to install a component into a mask of a gas turbine engine according to one disclosed non-limiting embodiment of the present disclosure includes a movable base and a drive movable along an axis with respect to said movable base.

In a further embodiment of the foregoing embodiment, the drive supports an insertion cup. In the alternative or additionally thereto, in the foregoing embodiment the insertion cup includes a semi-spherical. In the alternative or additionally thereto, in the foregoing embodiment the insertion cup is non-metallic.

In a further embodiment of any of the foregoing embodiments, the drive is a linear motor.

In a further embodiment of any of the foregoing embodiments, the system includes a lubrication mister directed toward said movable base.

In a further embodiment of any of the foregoing embodiments, the movable base is movable in an X-direction and Y-direction, said Z-direction defined along said axis.

In a further embodiment of any of the foregoing embodiments, the movable base includes a mask support movable with respect to a housing.

In a further embodiment of any of the foregoing embodiments, the movable base includes a mask support spring connected and biased between the housing and the mask support.

A method of masking a component of a gas turbine engine according to another disclosed non-limiting embodiment of the present disclosure includes pressing a component into a mask supported on a movable base.

In a further embodiment of the foregoing embodiment, the method includes permitting rotational movement of the movable bases.

In a further embodiment of any of the foregoing embodiments, the method includes permitting tilting movement of the movable bases.

In a further embodiment of any of the foregoing embodiments, the method includes pressing the component in a Z-direction and permitting movement of the movable bases in an X-direction and Y-direction.

In a further embodiment of any of the foregoing embodiments, the method includes spraying the component with a lubricant solution.

In a further embodiment of any of the foregoing embodiments, the method includes pressing the component with a semi-spherical insertion cup.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
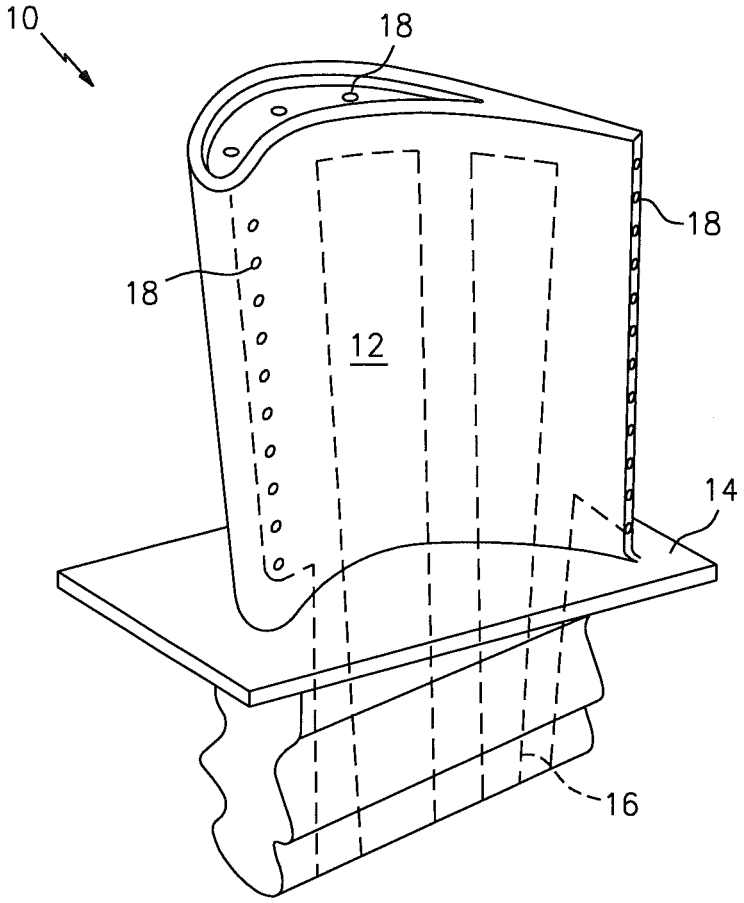
FIG. 1 is a perspective view of a turbine component.

FIG. 1 schematically illustrates a turbine component 10 that requires plating of only a portion thereof. The turbine component 10, for example a turbine rotor blade, includes an airfoil 12, a platform 14 and a root 16. The turbine component 10 is manufactured of a high temperature superalloy. It should be understood that not all turbine components as defined herein may be identical to that illustrated, and that other turbine components such as vanes and static structures that require a of the component to be masked will also benefit herefrom.

The turbine component 10 is plated along the airfoil 12, as the airfoil 12 is subjected to a core flow of corrosive, oxidative gases that impinge the airfoil 12 at temperatures in excess of 2400 degrees F. (1,315 degrees C.). The root 16 need not be plated and the platform 14 is segregates the airfoil 12 and the root 16. The root 16 also includes openings 18 to cooling passages to communicate a coolant through the airfoil 12 to thermally combat the core flow. The root 16 may be a fir-tree, dovetail, or other convoluted shapes which is precision machined to fit within a correspondingly shaped slot in a rotor disk assembly (not shown). Because of the precision machining, the addition of even small amounts of plating may adversely affect the tight tolerances in the assembly process. In addition, the plating materials may instigate fretting and thereby undesirably effect the fatigue life of the root 16.

Figure 2:
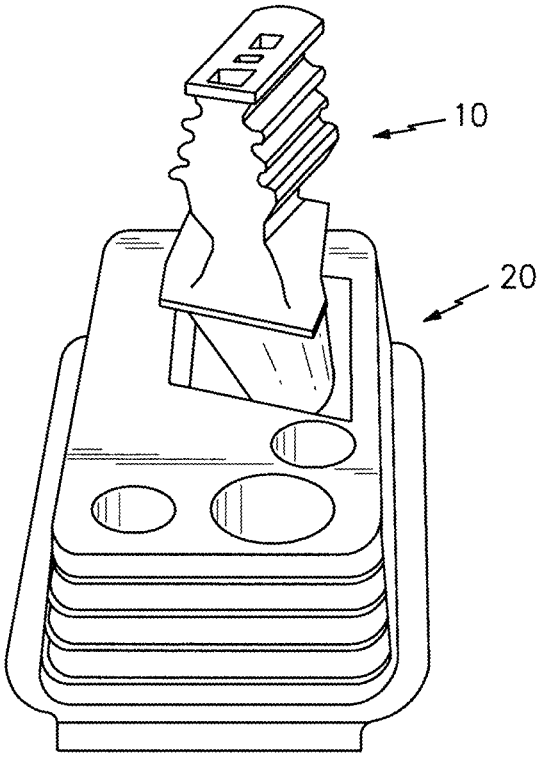
FIG. 2 is a top perspective view of the turbine component partially inserted into a mask.
Figure 3:
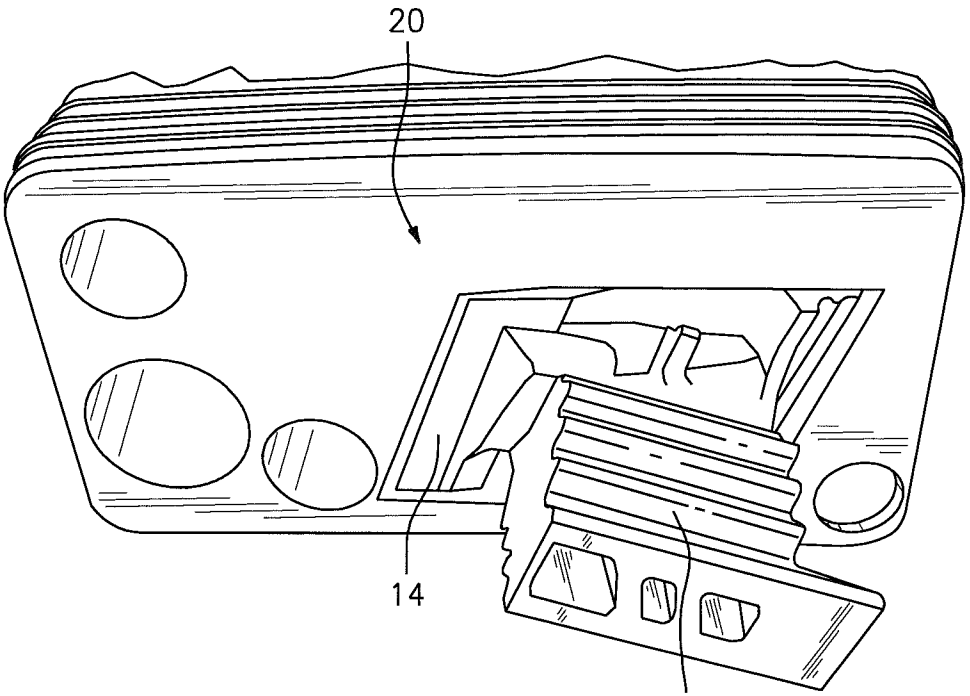
FIG. 3 is a bottom perspective view of the turbine component fully inserted into the mask.

With reference to FIG. 2, the root 16 of the turbine component 10 may be protected from a plating operation by a mask 20 that, in one disclosed non-limiting embodiment, is a resilient material that is generally block-shaped in the disclosed non-limiting embodiment but may be of other shapes and configurations. The mask 20 closely fits onto the airfoil 12 and the platform 14 to shield desired of the turbine component 10 from exposure to the plating materials. That is, the mask 20 includes an internal shape that closely mirrors (and may be an interference fits with) the airfoil 12 and the platform 14 contours (FIG. 3). Since the mask 20 is loaded into a fixture (not shown), the root 16 is segregated and thereby protected from the plating process.

Figure 4:
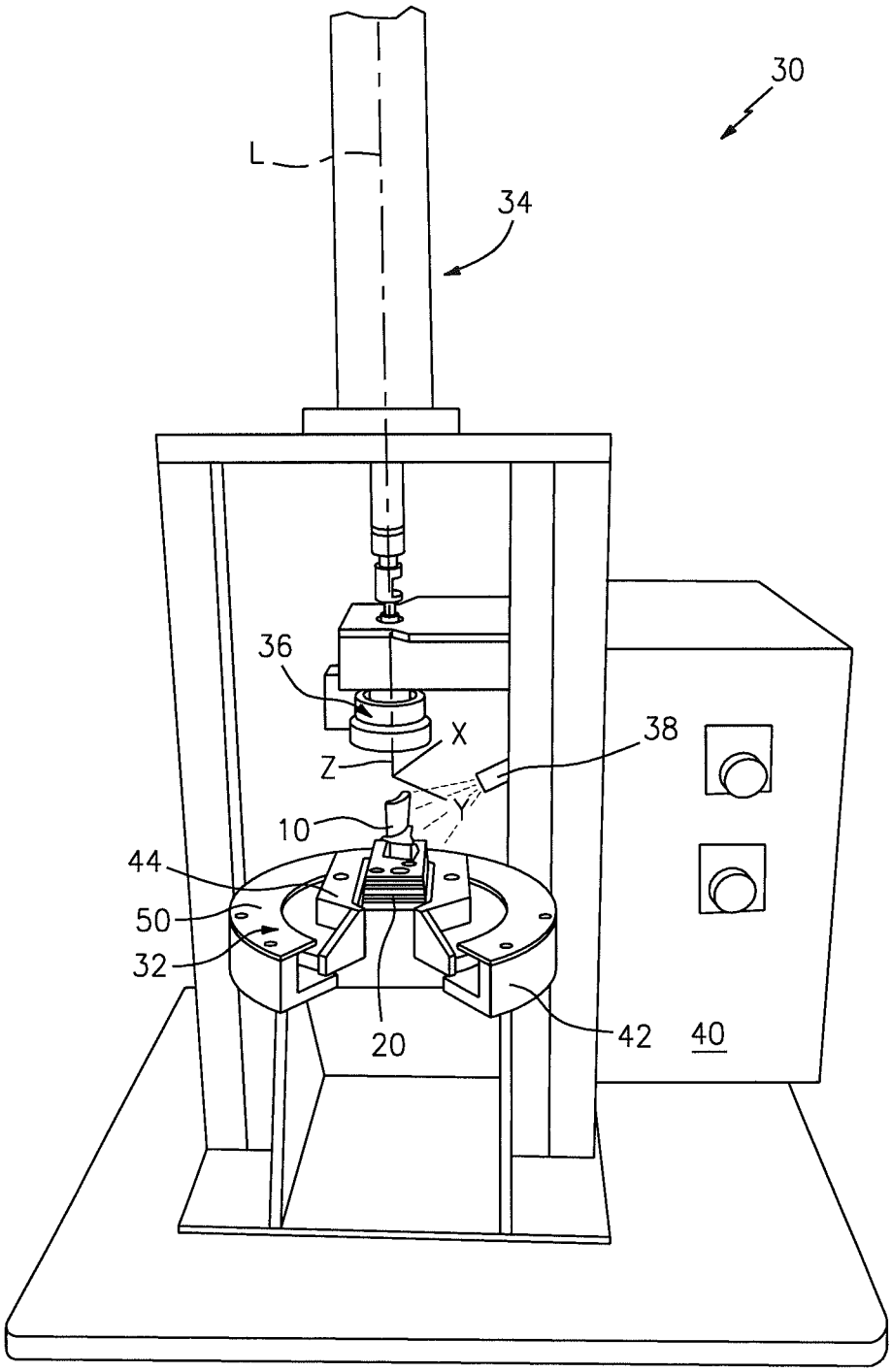
FIG. 4 is a schematic view of a system to press the turbine component into a mask.

With reference to FIG. 4, a system 30 facilitates installation of the turbine component 10 into the mask 20. The system 30 generally includes a movable base 32, a drive 34, an insertion cup 36, a lubricating mister 38 and a controller 40. The drive 34 is operable to press the turbine component 10 into the mask 20. It should be appreciated that alternative or additional subsystems may be provided.

Figure 5:
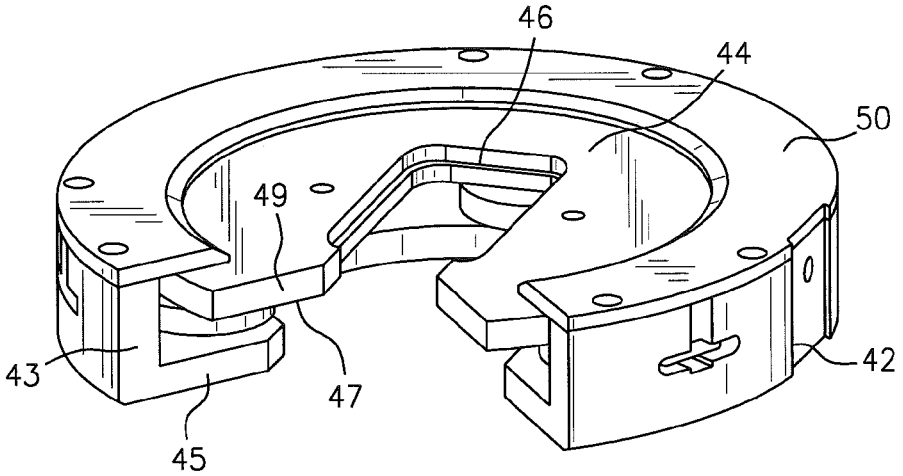
FIG. 5 is a schematic view of a movable base of the system to press the turbine component into the mask.

The movable base 32 includes a housing 42 and a mask support 44 which is resiliently mounted within the housing 42. The housing 42 may be semi-cylindrical with a cylindrical portion 43 and a radially extending base 45 from which the cylindrical portion 43 extends (see FIG. 5). The housing 42 includes a load/unload opening 47 that is generally mimicked by the mask support 44. In the disclosed non-limiting embodiment, an opening 46 includes a load/unload opening 47 to facilitate loading and unloading of the mask 20. The opening 46 and the load/unload opening 47 may be of various sizes and orientations so as to facilitate operator interaction with the mask 20.

Figure 6:
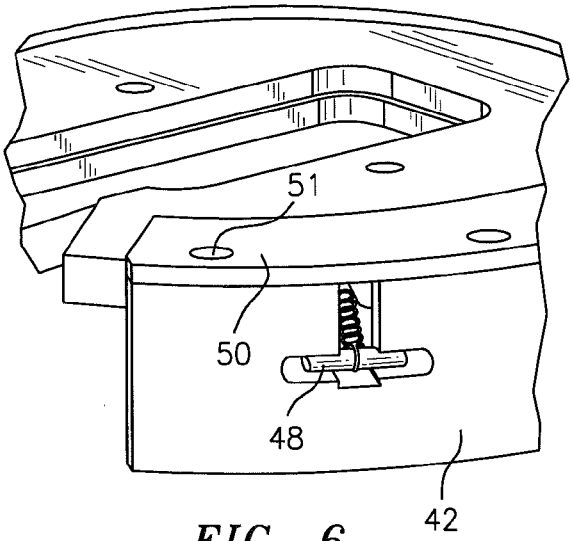
FIG. 6 is an expanded schematic view of a spring bias of the movable base.
Figure 7:
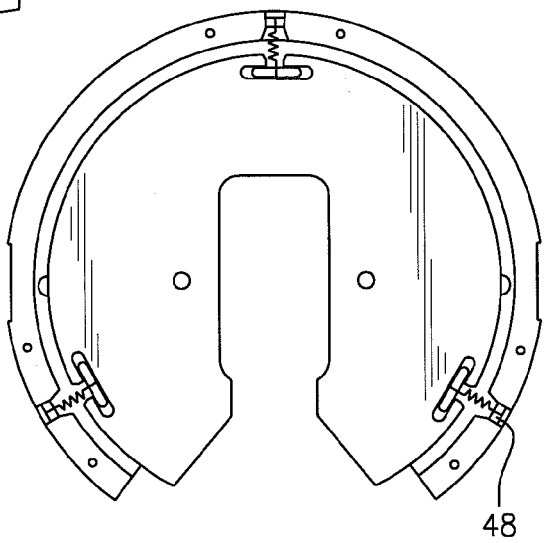
FIG. 7 is a top view of the movable base.
Figure 8:
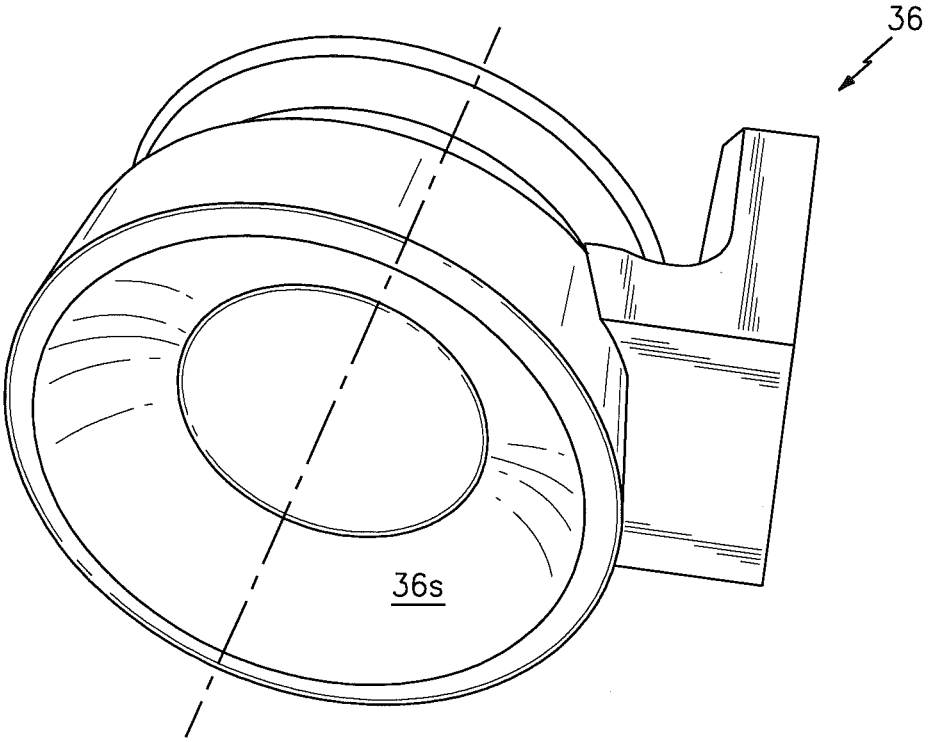
FIG. 8 is a schematic view of a insertion cup.

A resilient biasing member 48 (FIGS. 6 and 7) such as a multiple of springs or a bladder resiliently position the mask support 44 within the housing 42. The mask support 44 is at least partially enclosed by a cover 50 attached to the housing 42 with fasteners 51 to constrain movement of the mask support 44 in the X-direction, Y-direction, and Z-direction.

The drive 34 in the disclosed non-limiting embodiment is a variable speed linear motor. The insertion cup 36 is mounted to the drive 34 to provide a non-metallic semi-spherical engagement surface for contact with the turbine component 10. The insertion cup 36 prevent damage to the turbine component 10 and permits some relative movement between the turbine component 10 and the mask 20 as the turbine component 10 "wiggles" into the mask 20 under the linear force applied by the drive 34. The drive 34 may provide variable speed in that the insertion cup 36 is moved relatively rapidly under control of the controller 40 until contact with the turbine component 10 then reduces speed to carefully drive the turbine component 10 into the mask 20. The drive 34 generates, in one example, less than approximately 10 pounds of force.

The lubricating mister 38 is directed toward the mask 20 to selectively apply a mist of a lubricant such as a soap solution to the mask 20 in response to the controller 40. The lubricating mister 38 facilitates insertion of the turbine component 10 into the mask 20 as the as the turbine component 10 is "wiggled" into the mask 20 under the linear force applied by the drive 34.

Figure 9:
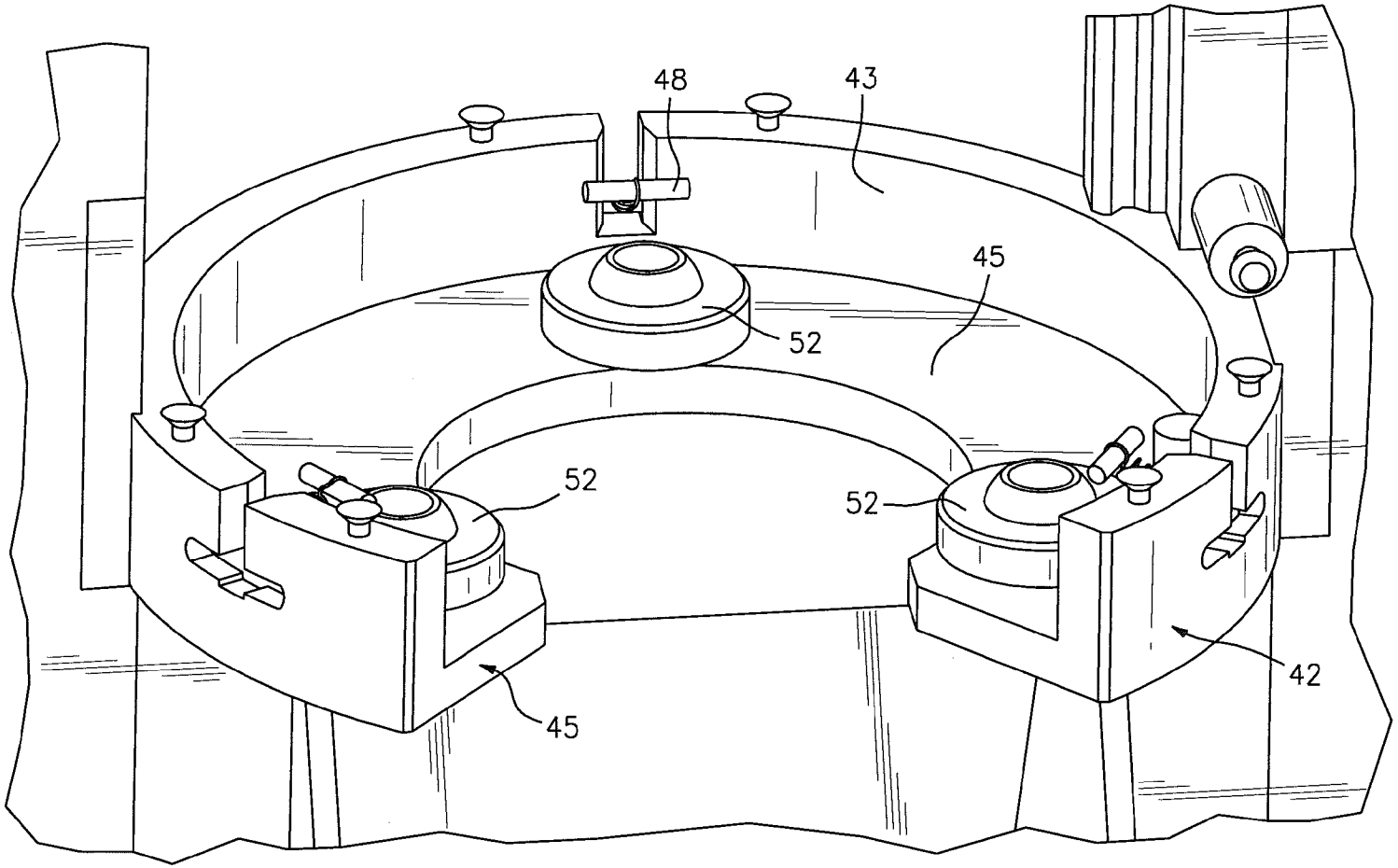
FIG. 9 is a schematic partially disassembled view of the movable base of the system to press the turbine component into the mask.

With reference to FIG. 9, a multiple of bumpers 52 accommodate unequal movement of the mask support 44 in the direction that the drive 34 presses—the Z-direction. The bumpers 52 may be rubber pucks that deform to accommodate the movement of the mask support 44. That is, the drive 34 presses along an L axis that is oriented in the Z-direction such that straight-line pressure on the turbine component 10 will result in contact between the mask support 44 and all the bumpers 52. The complex internal shape of the mask 20 which corresponds to the root 16, however, results in the linear force applied by the drive 34 to displace the mask support 44 in the X-direction and the Y-direction as the turbine component 10 "wiggles" into the mask 20 as the mask support 44 and thereby the mask 20 moves to accommodate this motion in combination with the insertion cup 36. The multiple of resilient biasing member 48 resiliently positions the mask support 44 within the housing 42 in the X-direction and the Y-direction while the bumpers accommodate movement in the Z-direction as the turbine component 10 "wiggles" into the mask 20.

Figure 10:
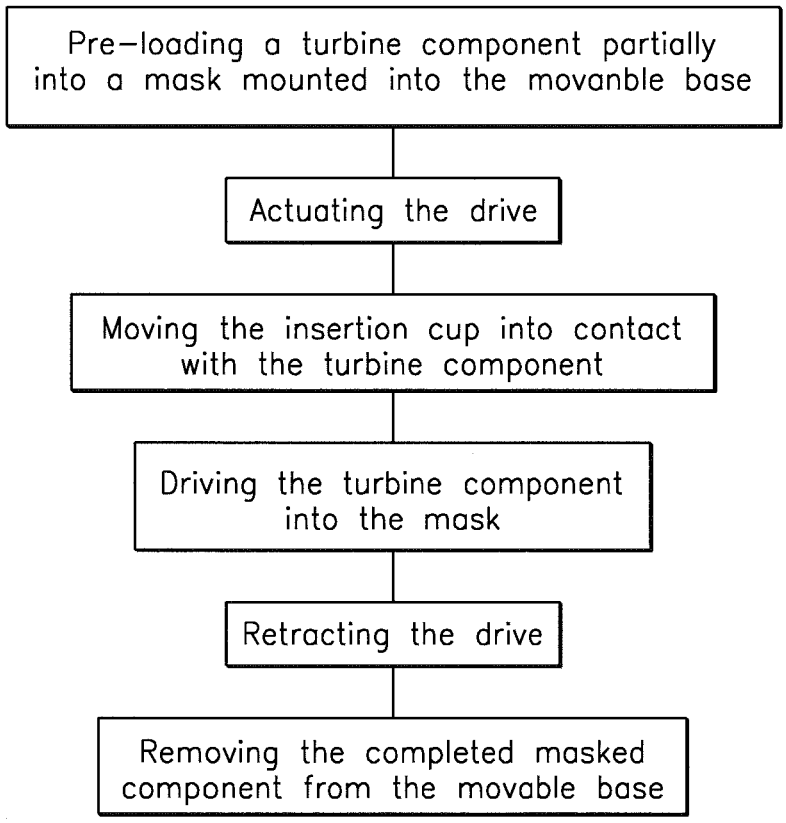
FIG. 10 is a flowchart of the method of masking a turbine component.

With reference to FIG. 10, an operator initially pre-loads the turbine component 10 partially into the mask 20. That is, the airfoil 12 is placed into the mask 20 which is mounted into the movable base 32. The drive 34 is then actuated. In response to the controller 40, the insertion cup 36 is moved relatively rapidly under control of the controller 40 until contact with the turbine component 10 then the controller 40 reduces speed of the drive to carefully drive the turbine component 10 into the mask 20. Once the turbine component 10 is pressed fully into the mask 20, the drive 34 retracts in response to the controller 40 and the operator may remove the completed masked component from the movable base 32. The disclosed process eliminates any potential for ergonomic effect upon the operator, allows for consistent masking, eliminates variation in the masking process. It should be appreciated that the disclosed process is readily applicable to other component insertion which may require some "wiggle".

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A system to install a component of a gas turbine engine into a mask comprising:

a movable base including a housing and a mask support, wherein said movable base includes a support spring connected and biased between said housing and said mask support;

a drive movable along an axis with respect to said movable base; and bumpers that deform to accommodate movement of the mask support upon actuating said drive to position the component into the mask.

2. The system as recited in claim 1, wherein said drive supports an insertion cup.

3. The system as recited in claim 2, wherein said insertion cup includes a semi-spherical engagement surface.

4. The system as recited in claim 2, wherein said insertion cup is non-metallic.

5. The system as recited in claim 1, wherein said drive is a linear motor.

6. The system as recited in claim 1, further comprising a lubrication mister directed toward said movable base.

7. The system as recited in claim 1, wherein said movable base is movable in an X-direction and Y-direction, said Z-direction defined along said axis.

8. The system as recited in claim 1, wherein said movable base includes the mask support movable with respect to the housing.

9. The system as recited in claim 1, wherein said movable base is semi-spherically shaped with end faces defining an opening for loading the mask, and wherein the mask support has a semi-spherical shape with end faces defining an opening which mimics the opening of the movable base and is positioned within an interior of the movable base.

10. A method of masking a component of a gas turbine engine comprising:

pressing a component into a mask supported by a mask support on a movable base that includes a housing; and deforming bumpers to accommodate movement of the mask support upon actuating a drive to position the component into the mask, wherein said movable base includes a support spring connected and biased between said housing and said mask.

11. The method as recited in claim 10, further comprising: permitting rotational movement of the movable base.

12. The method as recited in claim 10, further comprising: permitting tilting movement of the movable base.

13. The method as recited in claim 10, further comprising: pressing the component in a Z-direction; and permitting movement of the movable base in an X-direction and Y-direction.

14. The method as recited in claim 10, further comprising: spraying the component with a lubricant solution.

15. The method as recited in claim 10, further comprising: pressing the component with a semi-spherical insertion cup.

16. The method as recited in claim 10, wherein said movable base is semi-spherically shaped with end faces defining an opening for loading the mask, and wherein the mask support has a semi-spherical shape with end faces defining an opening which mimics the opening of the movable base and is positioned within an interior of the movable base.

17. A system to install a component of a gas turbine engine into a mask comprising:

a movable base including a housing and a mask support; and a drive movable along an axis with respect to said movable base, wherein said movable base includes a support spring connected and biased between said housing and said mask support, and wherein said movable base is semi-spherically shaped with end faces defining an opening for loading the mask, and wherein the mask support has a semi-spherical shape with end faces defining an opening which mimics the opening of the movable base and is positioned within an interior of the movable base.

18. The system as recited in claim 17, wherein said drive supports an insertion cup, and wherein said insertion cup includes a semi-spherical engagement surface, and wherein said insertion cup is non-metallic, and wherein said drive is a linear motor.

19. The system as recited in claim 17, further comprising: a lubrication mister directed toward said movable base.

* * * * *